US005215008A

United States Patent [19]

Kartovaara et al.

[11] Patent Number: 5,215,008

[45] Date of Patent: Jun. 1, 1993

[54] CALENDERING MACHINE FOR TESTING PAPER

[76] Inventors: Ilkka K. Kartovaara, Urheilutie 8 E b 7, SF-02700 Kauniainen; Erkka E. J. Valtonen, Aamuyöntie 8 C, SF-02210 Espoo, both of Finland

[21] Appl. No.: 782,209

[22] Filed: Oct. 24, 1991

[51] Int. Cl.[5] ..... B30B 3/04; D21G 1/00

[52] U.S. Cl. ..... 100/47; 100/99; 100/168; 200/61.14

[58] Field of Search ..... 100/47, 99, 155 R, 161, 100/168, 172, 93 RP; 34/89; 73/159; 68/13 R, 22 R; 200/61.13, 61.14

[56] References Cited

U.S. PATENT DOCUMENTS

| | | | |
|---|---|---|---|
| 2,691,326 | 10/1954 | McArn | 100/99 |
| 2,796,480 | 6/1957 | Knorr, Jr. | 200/61.14 |
| 3,262,054 | 7/1966 | Lefkowitz | 100/47 X |
| 3,521,551 | 7/1970 | Boxmeyer | 100/47 |
| 4,080,888 | 3/1978 | Bellis | 100/47 |
| 4,370,923 | 2/1983 | Schmidt | 100/47 |
| 4,477,981 | 10/1984 | Chan | 34/89 X |
| 4,608,765 | 9/1986 | Gunderson et al. | 34/89 X |
| 5,033,373 | 7/1991 | Brendel et al. | 100/161 X |

*Primary Examiner*—Stephen F. Gerrity

[57] ABSTRACT

A paper test calendering machine is constructed with a pair of opposed guide rolls about which a web of paper or the like travels. A pair of opening an closing nip rolls are operable to exert pressure on the traveling web. A sensing device is operable to detect a deviation in the smooth web and to then activate an element to relieve the pressure on the web momentarily as the deviation passes.

3 Claims, 2 Drawing Sheets

CALENDERING MACHINE FOR TESTING PAPER

BACKGROUND OF THE INVENTION

This invention relates to a laboratory calendering machine for comparing different calendering techniques, for example in connection with gradient calendering. Furthermore, said machine provides means for studying the effects calendering has on different parameters and variables related to paper or board or any other web material, for example on qualities such as roughness, gloss, strength, stiffness, moisture content and optical properties. Effects on other special properties, for example blistering tendency of coated paper, may also be studied.

Previously known laboratory calendering devices have only been designed for carrying out tests on individual socalled laboratory sheets. A known laboratory calendering device has consisted of a frame in which two nip forming rolls have been mounted. In order to steady the feeding of the sheets, a feeding table has usually been arranged in front of the nip formed between the two rolls. Understandably, feeding speed and the speed by which the sheet passes between the rolls has been slow and thus not comparable with a working speed of an actual production calender. This has restricted the use of such a known device as a research device. Moreover, when using a soft roll, the sheets cause damage to the roll. Consequently, test results have been of limited use and tend to be unreliable.

SUMMARY OF THE INVENTION

The basic objective of the present invention is to provide a laboratory calendering machine by which a strip of paper or board or any other web material in loop form may be calendered so that the calendering circumstances and process steps correspond to those of an actual production calender.

Another object of the invention is that such a laboratory calendering machine is of an uncomplicated design in order to be workable in a laboratory setting for the intended purpose.

Still another object of the invention is that such a laboratory calendering machine is of suitable dimensions and costs for use in a laboratory setting.

Briefly, in accordance with the present invention these and other objects are attained by providing a laboratory calendering machine, comprising a framework, at least two guide rolls mounted on respective shafts journalled to said framework, at least one of said shafts being a driven shaft, and at least one pair of nip forming rolls in between which a press nip is formed, said nip forming rolls being disposed in between said guide rolls. Thus, a web may be looped around the guide rolls and drawn through said nip in order to simulate an actual production calender. Furthermore, tensioning means may be provided in order to achieve a desired tension of the web.

The web preferably consists of a strip of paper or board joined together by adhesive means at two free ends in order to form an endless loop. Sensing means serve to detect the presence of the joinder means prior to it passing into the nip of the press rolls. Triggering means or opening and closing said nip and responsive to the sending of said adhesive means are provided.

Additionally said laboratory calendering machine is provided with adjustment means, whereby nip pressure may be adjusted in a sequential manner from 1 to n times, n being an integer such as 2,3,4 and so on. Hence, when said nip opening triggering means, in response to the web joint provided with the adhesive means, opens the nip, the web joint may pass through said nip and thereafter effect a closing of said nip by the nip closing means, so that said nip closes with a given pressure resulting in a certain treatment of the web corresponding to the treatment at one nip of a production calender. This may be repeated for a desired n number of times thereby simulating a set of n nips in the production calender.

Furthermore, parameters and variables such as hardness of the nip forming rolls, temperature of said rolls, speed of the web, line pressure, web moisture and temperature may be chosen for desired test purposes.

The laboratory calendering machine may thus also be used as a testing device for different roll materials.

These objects are achieved with a simple machine structure of relatively small size.

DETAILED DESCRIPTION OF A PREFERRED EMBODIMENT

Figure 1:
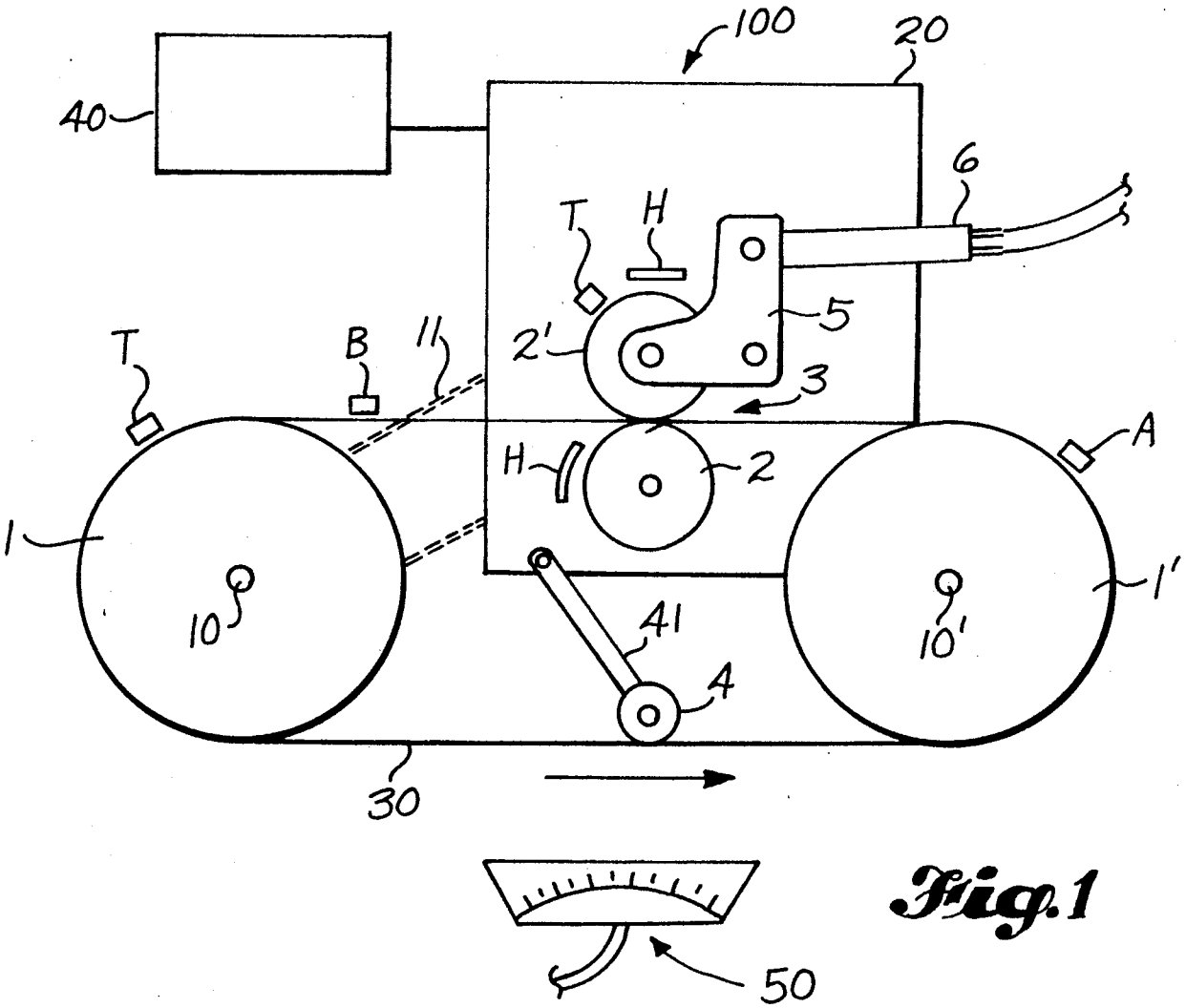
FIG. 1 is a schematic cross-sectional view of a laboratory calendering machine in accordance with the present invention.

FIG. 1 shows a laboratory calendering machine 100 according to the present invention comprising two guide rolls 1 and 1' mounted on respective shafts 10 and 10' journalled to a framework or machine stand (not shown). Said shafts lie at the same level of elevation. At least one of the shafts 10 is operatively connected to a source of power, such as an electric drive (not shown), by a drive transmission means 11 for driving the roll or rolls, which may be internally cooled or heated, at a given speed. Supported by the framework or machine stand is an auxiliary framework 20. Said auxiliary framework 20 provides support for two nip forming rolls 2 and 2', in between which a press nip 3 is formed, and tensioning means 4, e.g. a stretching roll. Said nip forming rolls 2 and 2' are also arranged to be operatively connected to said electric drive by drive transmission means (not shown). Said stretching roll 4 is pivotably connected to the auxiliary framework by an arm 41 which at one end is journalled to the auxiliary framework and at the other end to the stretching roll is journalled. The arrangement is such that the nip forming rolls and the stretching roll are disposed between the guide rolls. Thus a web 30 such as a particular type of paper may be looped around the guide rolls and passed through said nip. The stretching roll may be used to regulate the tension of the web, thus necessitating some biasing means (not shown). The web consists of a strip of paper or board or any other web material the free ends of which are joined together by adhesive means, such as tape or the like, in order to form a loop.

The arrangement of the nip forming rolls 2 and 2' is as follows. The lower nip forming roll 2 is journalled to the auxiliary framework 20, consisting principally of two parallel vertical plates, one of which is shown, and the upper nip forming roll 2' is journalled to a lever means. Said lever means mainly consists of a pair of L-shaped arms 5, one of which is shown, disposed at respective ends of the upper nip forming roll 2' and journalled to the auxiliary framework 20 from respective branching points of said L-shaped arms. The upper nip forming roll is journalled to the free ends of one of the branch pairs of said L-shaped arms. A hydraulic or pneumatic cylinder means 6 is operatively connected to the free ends of the other branchpair of said L-shaped arms. Said cylinder means 6 is thus arranged to lift or lower the upper nip forming roll 2' in order to open or close the nip 3.

Furthermore, the laboratory calendering machine according to the present invention is provided with sensing and triggering means A and B for effecting opening and closing of the nip 3 and being responsive to detection by the sensing means of the adhesive means joining said free ends of said strip of paper or board forming the web 30. Said nip opening sensing and triggering means A is disposed, seen in a running direction of the web (shown by an arrow), before the nip and said nip sensing and closing triggering means B is disposed after the nip. The placing of the triggering means A preferably is such that the nip 3 is opened in order to ensure that the adhesive means or other sensed deviation in the web may freely pass the nip. Placing the triggering means B in the vicinity of the nip 3 lengthens the calendered area. The opening of the nip is especially preferred for avoiding damage to soft rolls.

A heat sensor T is also placed in proximity to the guide roll 1 disposed after the nip 3 in order to measure the temperature of the web.

In proximity to each nip forming roll 2 and 2' are disposed heating means H, preferably infrared heaters. A heat sensor T is also placed in proximity to the upper nip forming roll 2'. Additional measuring means may be provided in accordance with desired testing methods.

When testing is carried out with the laboratory calendering machine (simulated production calendar) 100 a strip of paper or board or any other web material of a width corresponding to the width of the nip forming rolls (analogous to production calender rolls) 2 and 2' is prepared and cut to a length suitable for the size of the machine. The free ends of the strip are joined by the adhesive means and the strip is inserted into the calender. The nip 3 can be opened to such an extent by the lever and cylinder means 5 and 6 that heat possibly radiating from the calender rolls does not effect the strip (web) 30. Correspondingly the lower nip forming roll 2 may be arranged to be lifted and lowered. The electric drive preferably is such; that web speed may be adjusted in a stepwise fashion. When a test run is started the nip opening is adjusted according to the thickness of the web. With suitable instrumentation means 40 the nip 3 can be designed to close (and open) n times, for instance five times, with a given stepped adjustable pressure, whereby the nip pressure may be controlled e.g. by a quick servovalve and, when using a hydraulic cylinder, measure has a pressure difference in the servo cylinder An optional method is direct force measurement. The consecutive opening and closing is effected by the sensing and triggering means A and B responding to the adhesive means on the web 30. The heating of the calender rolls takes place with the infrared heaters H, whereby the temperature may be measured by the adjacent temperature sensor T. The degree of..moisture may be controlled by a manually operable moisture spray device 50 using water, steam or the like. Further control may be provided by air-conditioning of the laboratory room. The measurement of the nip distance is done by measuring the distance of the calender roll shafts, which is preferably done by a whole rotation of the rolls or a multiple thereof, whereby possible form errors in the calender roll shafts or bearings may be eliminated.

One of the nip forming rolls may also be connected to a separately adjustable drive mechanism. Thus the nip pressure may be lessened and speed gradient in the nip may be used for achieving different calendering effects.

Figure 2:
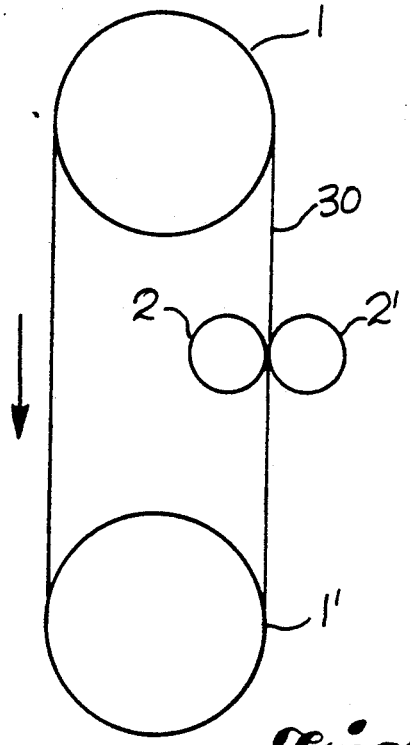
FIGS. 2,3 and 4 exemplify different arrangements of the laboratory calendering machine.

FIG. 2 shows an arrangement where the laboratory calendering machine is disposed in a vertical position. This arrangement may be preferable considering e.g. space and disposition of heating, measuring and moisturizing devices.

Figure 3:
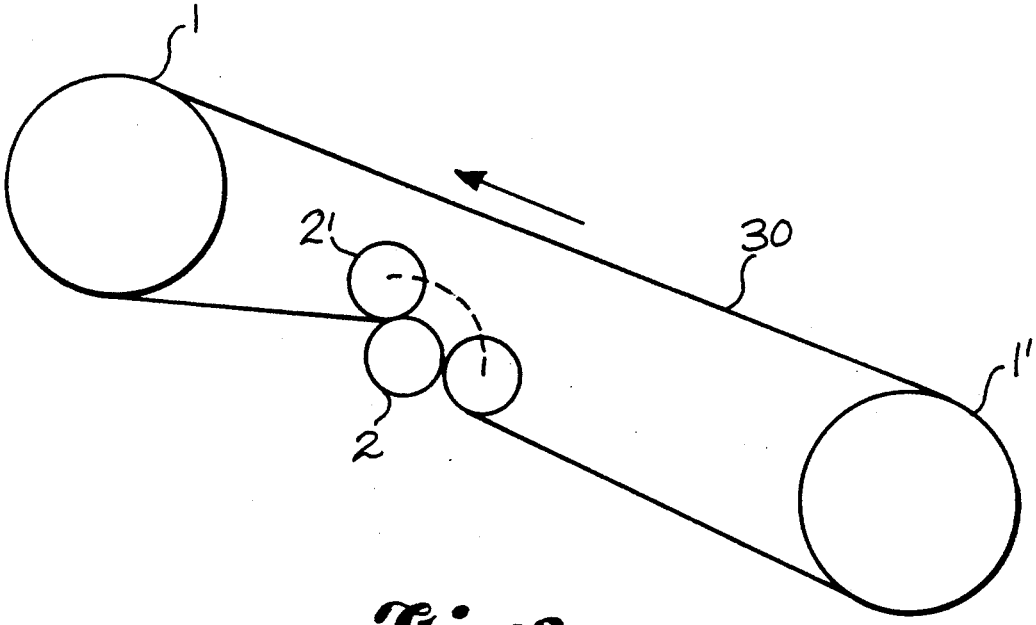

FIG. 3 shows an arrangement where the guide rolls 1 and 1' are disposed on different levels. This may be a preferable arrangement in cases where it is found useful for testing purposes that the web 30 travels along the nip forming rolls 2 and 2' for some distance instead of just contacting the nip forming rolls at one point as described in relation to FIG. 1 (different positions of the upper nip forming roll 2' are shown with broken lines). Thus the contact angle (wrap angle) of the web may be adjusted by providing suitable adjustment means, preferably also including means for adjusting the position of said nip forming rolls.

Figure 4:
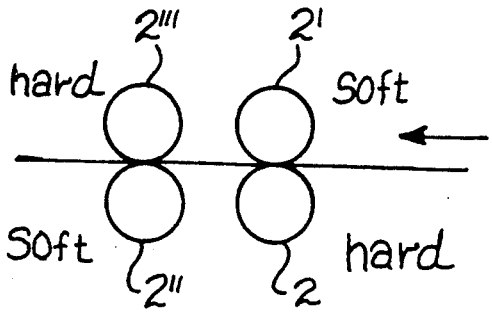

FIG. 4 shows an arrangement where the laboratory calendering machine has tow set of nip forming rolls 2 and 2' respectively 2'' and 2'''. This may be a preferably arrangement when it is desired to simulate a set of different nips comprising firstly e.g. a soft upper nip forming roll 2' and a hard lower nip forming roll 2 and secondly a hard upper nip forming roll 2''' and a soft lower nip forming roll 2''. Other combinations of nip forming (calendering) rolls are naturally also possible.

Individual sheets may also be calendered with the laboratory calendering machine according to the present invention. Thus, the web has two joints provided with adhesive means, whereby the triggering system has to be adjusted accordingly.

The web joint or joints may also be provided with other joining means instead of the adhesive means described above.

Furthermore, the web may be prepared as a complete loop, whereby the web may be provided with any desirable marking means to which the sensing and triggering means maybe responsive in order to effect opening and closing of the nip.

All the above related controlling, measuring and monitoring, including calibration (defining the zero point of the nip distance), may be programmed by contemporary state of the art methods to suit desired testing methods.

TESTING EXAMPLE

The following may be given as an example of testing values: heating of metal calender rolls up to 200° C., web speeds of 2.5, 5.0 and 7.0 m/s (which is equivalent to web speed of 14 m/s of a production calender), line pressure up to 370 kN/m, number of nips n=5 and, using soft calender rolls, roll hardness of 75, 87 and 95 Shore D. One has to observe that these are not limit values in regard to the laboratory calendering machine according to the present invention, for instance a web speed of 20 m/s has been found feasible. An example of the length and width of a testing web is 2.3 m . 0.13 m giving approximately 1 m of useful sample for analysis. The measurements on the strip of paper or board are thus made in a well calendered area, which may be estimated according to the time delay of triggering, which can be calculated from the hydraulic or pneumatic properties of the hydraulic or pneumatic cylinder means 6. This also applies to on-line measurements.

Although only a preferred embodiment is specifically illustrated and described herein, it will be appreciated that many modifications and variations of the present invention are possible in the light of the above teachings and within the purview of the appended claims without departing from the spirit and intended scope of the invention.

What is claimed is:

1. A calendering machine for testing paper, said test paper formed as a sheet having first and second ends which are joined together by means to form a joint to thereby form an endless loop, said machine having at least two spaced part guide rolls mounted on a framework about which said endless loop of test paper is placed and guided, and at least one pair of variable pressure nip forming calendering rolls for calendering said endless loop which are openable and closeable and located between the guide rolls, the improvement comprising:

sensing means for detecting a mark on the endless loop;

means responsive to the sensing means detecting said mark for effecting an opening of said calendering nip at a controlled time and then effecting a closing of said calendering nip; and means for varying the nip pressure whereby in response to the opening and closing of said calendering nip the pressure may be varies to simulate different nip-types.

2. A machine as in claim 1 in which the sensing means detects the joint.

3. A machine as in claim 2 in which said means to join said ends of the strip is an adhesive means and wherein the sensing means detects the adhesive means.

* * * * *

UNITED STATES PATENT AND TRADEMARK OFFICE

CERTIFICATE OF CORRECTION

PATENT NO. : 5,215,008

DATED : June 1, 1993

INVENTOR(S) : Ilkka K. Kartovaara; Erkka E.J. Valtonen

It is certified that error appears in the above-identified patent and that said Letters Patent is hereby corrected as shown below:

In column 5, line 16, "part" should read --apart--;

in column 6, line 12, "varies" should read --varied--;

Signed and Sealed this

Eighth Day of February, 1994

Bruce Lehman

*Attest:*

BRUCE LEHMAN

*Attesting Officer*

*Commissioner of Patents and Trademarks*